United States Patent [19]

Chauvier et al.

[11] Patent Number: 4,790,344

[45] Date of Patent: Dec. 13, 1988

[54] FLUID FLOW REGULATOR

[76] Inventor: Daniel J. V. D. Chauvier; Peter Woodman, both of 57 Miller Road, Nuffield Springs, South Africa

[21] Appl. No.: 32,621

[22] Filed: Apr. 1, 1987

[30] Foreign Application Priority Data

Mar. 27, 1986 [ZA] South Africa ..... 86/2317
Apr. 2, 1986 [ZA] South Africa ..... 86/2408
Sep. 17, 1986 [ZA] South Africa ..... 86/7062

[51] Int. Cl.[4] ..... F16K 31/12

[52] U.S. Cl. ..... 137/112; 15/1.7; 137/624.14; 137/624.17; 137/907; 251/5

[58] Field of Search ..... 15/1.7; 137/98, 103, 137/105, 112, 624.14, 624.17; 251/5

[56] References Cited

U.S. PATENT DOCUMENTS 2,041,491 5/1936 Russell ..... 137/112 X
2,292,401 8/1942 Orre ..... 137/103
4,023,227 5/1977 Chauvier ..... 15/1.7
4,558,479 12/1985 Greskovics ..... 15/1.7
4,592,379 6/1986 Goettl ..... 137/624.14 X

*Primary Examiner*—Robert G. Nilson
*Attorney, Agent, or Firm*—Donald A. Kaul

[57] ABSTRACT

A fluid flow regulator 10 comprises a body 11 defining three converging flow passages A, B and C between inlets 14, 13 and 12 respectively, and outlet 15, which is connectable to a suction source. Passages A and B each includes a valve. Turbine 16 in passage C drives actuating means periodically to operate the valves thereby to cause passages A and B periodically to be opened and closed in tandem. The regulator may be employed to suck predetermined quantities of fluid from two sources connected to inlets 14 and 13, respectively. Another embodiment serves as displacement apparatus for a submersible cleaner. With passage B open to admit water to drive a propeller 34 for displacing the apparatus and cleaner, passage A is closed to reduce suction at the cleaner. With passage B closed, passage A is open to transmit suction to the cleaner for it to be propelled by its own driving mechanism.

18 Claims, 4 Drawing Sheets

FLUID FLOW REGULATOR

THIS invention relates to fluid flow regulators and in particular to hydraulically controllable flow regulators.

Fluid flow regulators for use with submersible suction cleaners and more particularly flow regulators adapted to create a reverse thrust for such cleaners thereby to drive the cleaner rearwardly or upwardly for a short time interval to prevent it from becoming trapped in a certain region in the pool or against a submerged obstruction, are known. However, these known regulators, such as that disclosed in U.S. Pat. No. 3,392,738 and U.S. Pat. No. 4,558,479 to Pansini and Greskovics et al, respectively are concerned with cleaners of the kind wherein water under pressure is utilized to dislodge and/or collect debris from the pool floor and sidewalls.

Submersible cleaners of the kind wherein suction from the conventional or normal pool treatment plant is utilised to cause movement of the cleaner about in the pool under the influence of kinetic energy imparted to the cleaner due to an intermittent variation in the flow through the cleaner, present their own difficulties to be conquered in a flow regulator adapted to cause a reverse thrust for these devices.

It is an object of this invention to provide flow regulating means adapted for use in suction systems and in particular for use with submersible suction cleaners of the kind in question.

According to the invention fluid flow regulating means comprises

- a first flow passage extending between an inlet thereto and an cutlet therefrom;
- a second flow passage extending between an inlet thereto and an outlet therefrom;
- the outlets being adapted in use to be connected to a single suction source so that suction may be applied through both flow passages for causing fluid flow therethrough;
- first and second valve assemblies operable to open and close the first and second flow passages, respectively;
- actuating means adapted to operate the two valve assemblies, and
- fluid driven means adapted to drive the actuating means to operate the valve assemblies to open and close their respective passages in tandem so that when one passage is open, the other is closed.

The fluid flow regulating means may comprise a body wherein the first and second flow passages are defined and wherein the flow passages converge into each other downstream of the valve assemblies.

The actuating means may be adapted to operate the valve assemblies to open and close their respective flow passages for predetermined periods in response to predetermined volumes of fluid having passed the fluid driven means. The predetermined periods may be proportional to the volumes of fluid having passed the fluid driven means.

At least one of the valve assemblies may comprise a body defining a flow passage therethrough and a pressure operable closure member for opening and closing said flow passage.

The actuating means may be adapated periodically to vary pressure acting on the pressure operable closure member to operate such member.

The actuating means may hence comprise a variable volume chamber for causing the valve closure member to move between its open and closed positions; a rigid variable pressure chamber communicating with the variable volume chamber and also with suction pressure downstream of the closure member, the variable pressure chamber further having an equalization port communicating with ambient pressure; and a closure member for the equalization port operable by the aforementioned fluid driven means to move between a position wherein it is in sealing engagement with the port and a position away from the port.

The actuating means may further comprise a gear train inter-connecting the fluid driven means and the closure member for the equalization port of the variable pressure chamber.

A cam may be provided for operating the closure member, the cam being connected to the output of the gear train, the input of which is connected to the fluid driven means. The cam may be programmable so that the intervals between opening and closing the equalization port may be adjusted.

The closure member for the equalization port of the variable pressure chamber may be lever operable and biassed towards the position wherein it is in sealing engagement with the port. The cam may be mounted, in use, periodically to engage the lever to move the closure member between the position wherein it is in sealing engagement with the port and the position away from said port.

The valve closure member of at least one of the valve assemblies may comprise a transversely contractable and expansible tubular member the bore of which defines at least part of the flow passage through the valve body and the variable volume chamber may be located in the valve body immediately externally of the tubular member.

Together with, or, alternatively to the above valve assembly the variable volume chamber associated with at least one of the valve closure members may be defined within a longitudinally contractable and expansible bellows member, the bellows member being connected at its one end to the valve closure member for periodically moving the closure member between its open and closed positions.

The valve closure member may comprise a rigid member connected to the end of the bellows member by a tubular stem communicating at its one end with the chamber within the bellows member and at its other end with suction pressure through a bore defined through the closure member.

Hence, in one embodiment of the flow regulating means according to the invention the valve assembly for one of the flow passages comprises a transversely contractable and expansible closure member as hereinbefore defined, while the valve assembly for the other flow passage comprises a rigid closure member operable by variations in pressure within a longitudinally contractable and expansible bellows member as hereinbefore defined.

As a first alternative both flow passages may comprise valve assemblies of the former kind and as a second alternative both flow passages may comprise valve assemblies of the latter kind.

The body of the fluid regulating means according to the invention may also define a third flow passage therethrough, the third flow passage extending between an inlet thereto and the outlet from the body and having a chamber intermediate the inlet and the outlet wherein the fluid driven means is mounted.

In the preferred embodiment the fluid driven means comprises a turbine mounted for rotation in the said chamber.

It will be appreciated that the above defined regulating means may be used to mix two fluids into predetermined proportions. It may, for example, be used to chlorinate the water circulating through the filtration system of a swimming pool. In order to accomplish this, the water may be caused to enter through the inlet of the first flow passage and a source containing chlorine dissolved in a suitable liquid may be connected to the inlet of the second flow passage. The inlet of the third flow passage, in such an application, may be a small bleed opening connected to or submerged in either of the abovementioned sources or even a third source. With a proper selection of the intervals on the programmable cam, the first and second flow passages may be caused to open and close for predetermined periods so that predetermined quantities of the liquids may be sucked from their respective sources to be mixed together in predetermined proportions.

In another embodiment of the flow regulating means according to the invention it may be used as a displacement apparatus for a submersible cleaner.

According to this embodiment of the invention the fluid flow regulating means may also comprise drive means operable by a stream of water flowing through one of the flow passages for periodically propelling the body when submerged in the water.

The drive means may comprise an impeller rotatably mounted in the second flow passage in such a way that a stream of water through that passage, in use, causes rotation thereof, which rotation in turn is transmitted to a propeller connected to the impeller.

Hence, with the inlet of the first flow passage connected to the cleaner, the outlet thereof connected to the suction source and the propeller and inlets to the second and the third flow passages submerged in the water, the propeller may periodically be activated as water periodically flows through the second flow passage to displace the cleaner from its present position to another position.

It will be appreciated that with the first and second flow passages being opened and closed in tandem and with the timing such that the second flow passage, which includes the impeller, is opened only for short periods, the propeller is activated for those short periods only to displace the cleaner. During these short periods the suction of the cleaner on the walls and floor of the pool is reduced by the closed valve in the first flow passage so that the cleaner during these periods is paralized to facilitate displacement thereof by the regulating means acting as displacement apparatus.

The invention will now further be described by way of example only with reference to the accompanying diagrams in which.

Figure 1:
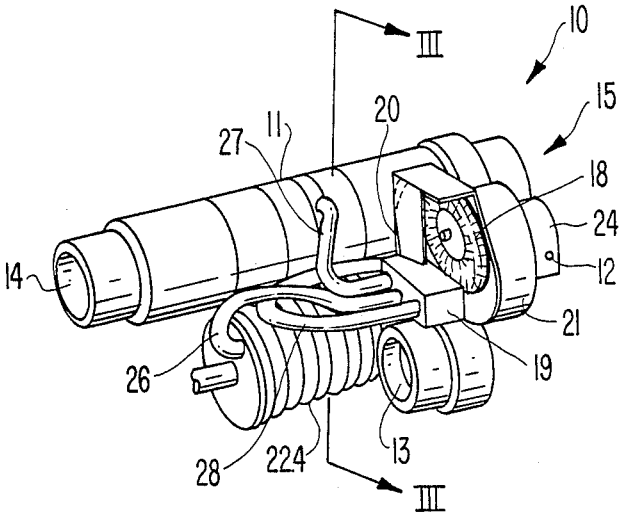
FIG. 1 is a diagrammatic perspective view of fluid flow regulating means according to the invention.
Figure 3A:
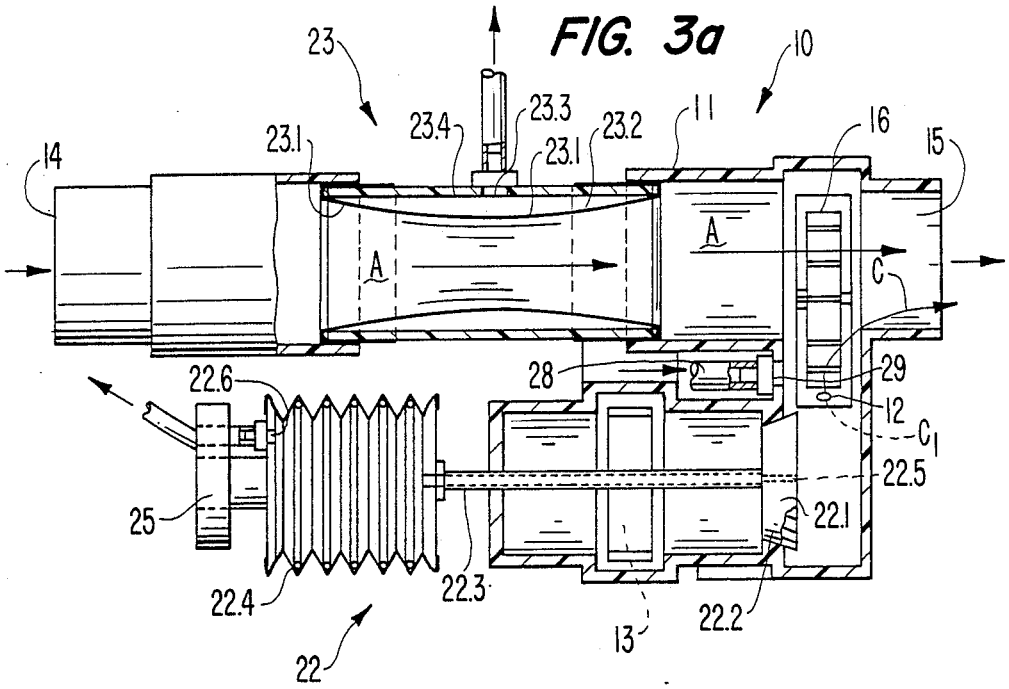
Figure 3B:
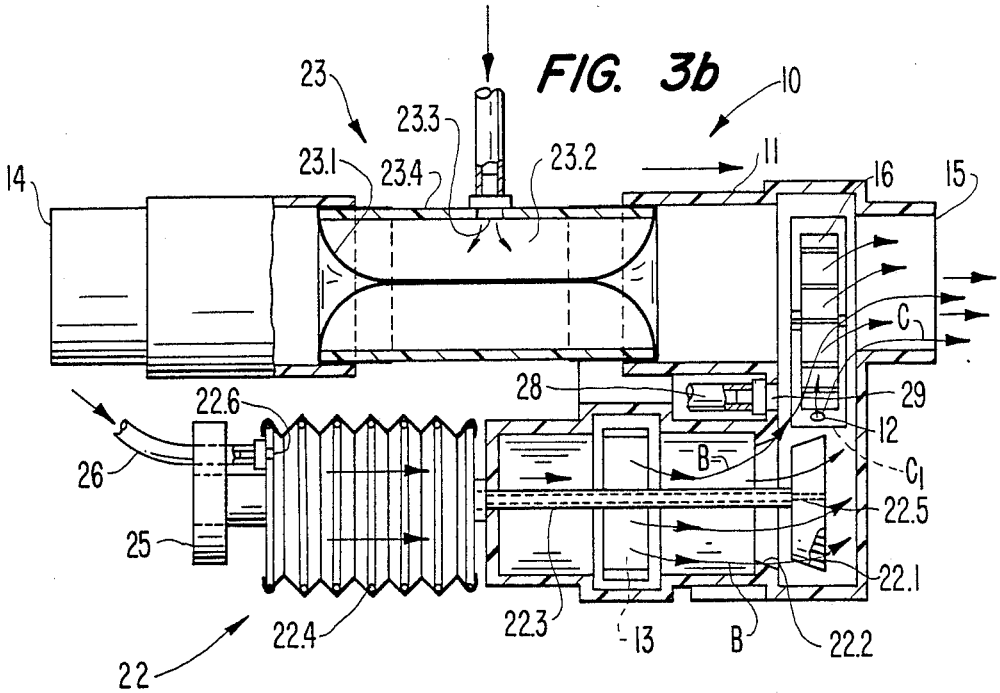

FIGS. 3*a* and 3*b* are longitudinal sectional views, taken along the line III—III of FIG. 1, through the regulating means, showing the valves associated with two flow passages through the apparatus in their open and closed conditions, respectively.

Figure 2:
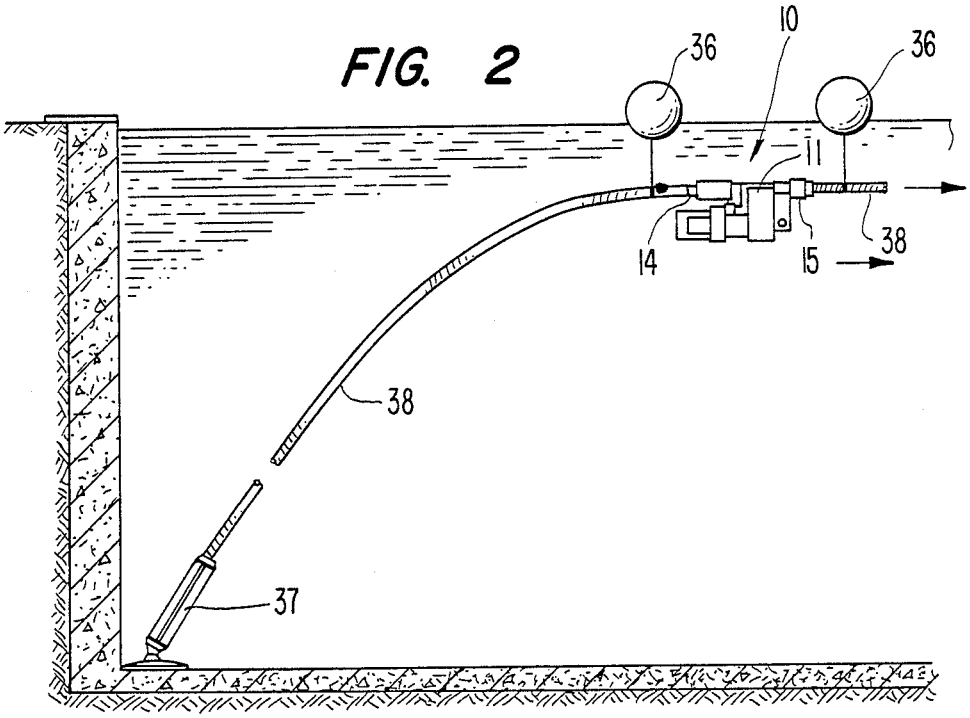
FIG. 2 is a diagrammatic representation of one embodiment of the fluid flow regulating means according to the invention wherein it is utilised as a displacement apparatus for a submersible suction cleaner for a swimming pool.
Figure 4:
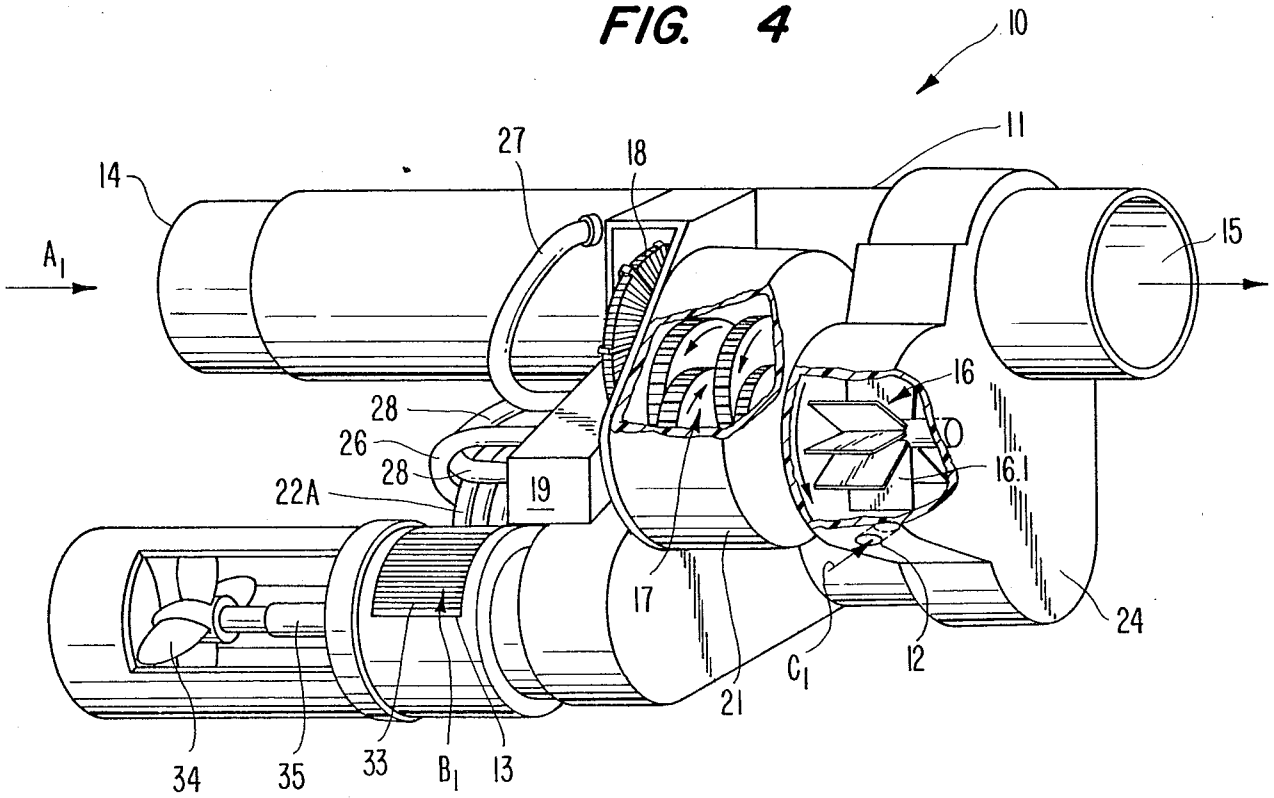
Figure 5A:
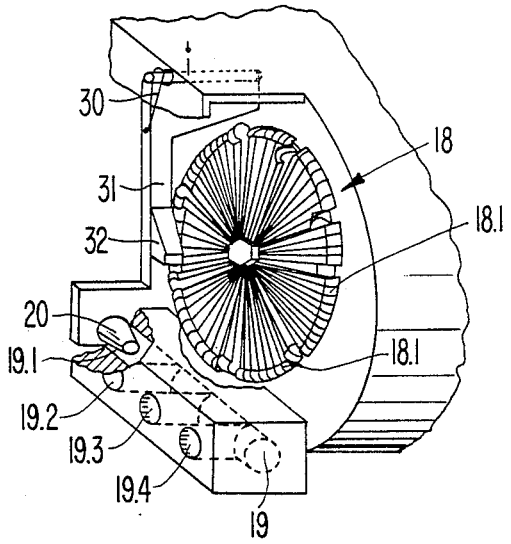
Figure 5B:
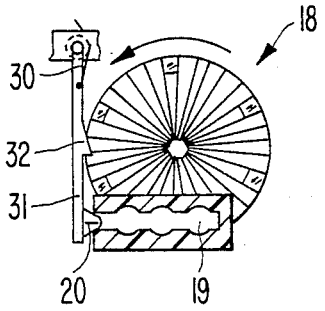
Figure 6:
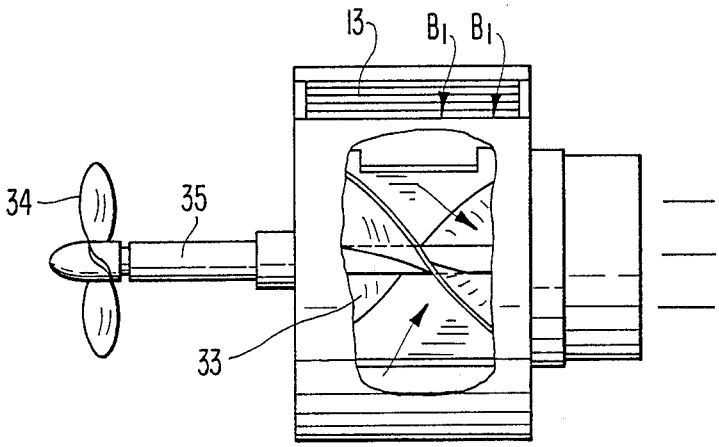

FIG. 4 is a diagrammatic partially broken away perspective view of the embodiment of the regulating means shown in FIG. 2, showing the inlet to a third flow passage, fluid driven means and actuating means associated therewith;

FIG. 5*a* is a diagrammatic perspective view of another part of the actuating means showing a cam for actuating a lever operable closure member for an inlet to a variable pressure chamber;

FIGS. 5*b* and *c* shows the closure member shown in FIG. 5*a* in its closed and open conditions respectively; and FIG. 6 is a diagrammatic partially broken away side elevation of the drive means for the embodiment of the fluid flow regulating means shown in FIG. 2.

The fluid flow regulating means according to the invention is generally designated by the reference numeral 1 in FIGS. 1, 2, 3, and 4. The fluid flow regulating means according to the invention comprises a body 11 defining as more clearly shown in FIGS. 3*a* and 3*b*, a first flow passage A (shown in FIG. 3*a*), a second flow passage B (shown in FIG. 3*b*), and a third flow passage C therethrough. The body further defines inlet 12 for flow passage C, inlet 13 for flow passage B and inlet 14 for flow passage A. The flow passages A, B, and C converge into one another so that the body 11 may be connected via outlet 15 to a single suction source (not shown).

As more clearly shown in FIGS. 4 and 5 the regulating means further comprises fluid driven means in the form of a turbine 16 rotatably mounted in third flow passage C. Furthermore, actuating means in the form of gear train 17, cam 18, a constant volume variable pressure chamber 19, and a closure member 20 for an inlet 19.1 to the variable pressure chamber 19, causes valve 22, associated with the second flow passage B, and valve 23, located in the first flow passage A, (both valves being shown in FIG. 3) intermittently to open and close their respective flow passages in response to predetermined volumes of fluid having passed the turbine 16 in thrid flow passage C.

Still referring to FIGS. 1, 3, and 4, third flow passage C extends from inlet 12, defined in a housing 24 and communicates with outlet 15. Turbine 16 is rotatably mounted in housing 24. Hence, with the regulating means submerged in water, a stream of water C1, will enter this flow passage under the influence of suction applied at the outlet 15. This stream will impinge on vanes 16.1 of turbine 16 thereby to cause rotation of the latter.

The second flow passage B extends between inlet 13 and outlet 15. Valve 22 is associated with this flow passage and serves to open and close it under the influence of the actuating means, the working of which will be described in more detail hereunder. Valve 22 comprises a rigid closure member 22.1 adapted to be moved into sealing engagement with valve seat 22.2, as shown in FIG. 3*a*, and away from said seat, as shown in FIG. 3*b*, to close and open flow passage B. Valve 22 further comprises a hollow stem 22.3 connecting the closure member 22.1 to one end of a bellows member 22.4. The bellows member 22.4 at its other end is rigidly connected to a bracket 25 mounted on the body 11 of the regulating means 10. Stem 22.3 communicates with the variable volume chamber in the interior of the bellows member 22.4 and with a port 22.5 defined in the closure member 22.1. Hence, when suction is applied at outlet 15, the pressure inside the bellows member 22.4 is lower than on the outside thereof so that bellows member 22.4 will be longitudinally contracted and the closure member 22.1 drawn into sealing engagement with seat 22.2 The bellows 22.4 also defines an equalization port 22.6 therein which port communicates with variable pressure chamber 19. The pressure inside the bellows member 22.4 may be varied through this port as will be described in more detail hereunder.

The first flow passage A extends between inlet 14 and outlet 15. A valve 23 comprising a transversely contractable and expansible elastomeric tubular member 23.1 circumscribed by an annular variable volume chamber 23.2 is mounted in a region between inlet 14 and outlet 15. An equalization port 23.3, which also communicates with the variable pressure chamber 19, is provided in the wall 23.4 circumscribing the variable volume chamber 23.2. Valve 23 serves to open and close the first flow passage A under the influence of the actuating means, as will be described hereunder.

The chamber on the inside of bellows member 22.4 of valve 22, as shown in FIGS. 3, 4 and 5*a*, communicates with variable pressure chamber 19 through outlet 19.3 defined in chamber 19, tube 26 and equalization port 22.6 defined in the bellows member 22.4 as shown in FIG. 3. Furthermore the variable volume chamber 23.2 of valve 23 communicates with the variable pressure chamber 19 through outlet 19.2 defined in chamber 19, tube 27 and equalization port 23.3 defined in wall 23.4 of valve 23, shown in FIG. 3. The variable pressure chamber 19 further communicates with outlet 15 of the regulating means through outlet 19.4 defined in chamber 19, tube 28 and port 29 defined in the body towards the outlet 15 thereof, as shown in FIG. 3.

Figure 5C:
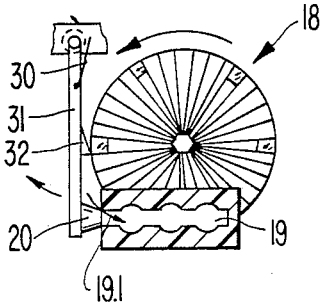

Lever operable closure member 20, shown in FIG. 5, serves to open and close inlet 19.1 defined in variable pressure chamber 19. The closure member 20 is biased towards its closed position, that shown in FIG. 5*b*, by a spring 30. The lever 31 presents a follower 32 for following cam 18. Hence, as cam 18 is caused to rotate, it will cause closure member 20 periodically to move between its open and closed positions. The open position of the closure member 20 is shown in FIG. 5C.

It will be appreciated that with closure member 20 in its closed position and suction being applied at outlet 15 of regulating means 10, variable pressure chamber 19 will be evacuated through tubes 28 and/or 26 communicating with the outlet 15 and chamber 19. Accordingly the bellows member 22.4 of valve 22 and the variable volume chamber 23.2 of valve 23 will also be evacuated. The pressure on either side of the tubular closure member 23.1 will be substantially equal, so that flow passage A will be open for fluid to flow therethrough. At the same time bellows member 22.4 will be longitudinally contracted so that second flow passage B will be closed.

However, when closure member 20 of variable pressure chamber 19 is caused by cam 18 to move away from inlet 19.1, the pressure inside chamber 19 will rise to a level substantially equal to ambient pressure. The pressure inside variable volume chamber 23.2 of valve 23 will accordingly also rise so that tubular closure member 23.1 will be caused transversely to contract thereby to close flow passage A. At the same time the higher pressure inside bellows member 22.4 of valve 22 will cause that member longitudinally to expand thereby to move closure member 22.1 away from seat 22.2 to open flow passage B.

As shown in FIG. 4, cam 18 is caused to rotate by gear train 17 mounted in gear box 21. Gear train 17 at its input end is driven by turbine 16 and at its output end is drivingly connected to cam 18 to cause rotation of the latter.

Cam 18, as more clearly shown in FIGS. 5*a* to *c*, comprises a wheel having a plurality of radially extending fingers 18.1. The fingers 18.1 are axially displaceable so that the contour of cam 18 is programmable. The periods for which the closure member 20, associated with inlet 19.1 of the variable pressure chamber 19 are caused to be in its open and closed positions may hence be varied so that the periods during which valves 22 and 23 will be open and closed may also be varied.

The first embodiment of the regulating means, that shown in FIG. 1, may be utilised to mix two fluids in predetermined proportions. This may be achieved by connecting inlet 14 of flow passage A to a source of the first fluid and inlet 13 of flow passage B to a source of the second fluid. Inlet 12, which is a small bleed opening, may be connected to a third source or may be submerged into one of the first or second sources. Hence, when suction is applied at the outlet 15, turbine 16 will be caused to rotate by fluid flowing through passage C. Turbine 16 in turn drives gear train 17 which again causes cam 18 to rotate. Rotating cam 18 causes closure member 20 periodically to open and close inlet 19.1 of variable pressure chamber 19. As described hereabove, the periods during which valves 22 and 23, which are working in tandem, will be open and closed may be selected, so that predetermined quantities of the fluids may be added together.

A second embodiment of the regulating means according to the invention may be employed as a displacement apparatus for a submersible suction cleaner. This embodiment of the regulating means shown in more detail in FIGS. 2 to 6, differs from the embodiment shown in FIG. 1 in that drive means in the form of an impeller driven propeller is provided for propelling the body 11 when submerged in water. As best shown in FIGS. 4 and 6 impeller 33 is rotatably mounted in flow passage B and is drivingly connected to propeller 34 by means of drive shaft 35.

As shown in FIG. 2, body 11 in use is suspended between two floats 36 to be submerged in the water at a level just below the surface thereof. Inlet 14 of flow passage A is connected to a submersible suction cleaner 37 by means of flexible hose 38 and outlet 15 is connected to a suction source (not shown) also by means of a flexible hose 38. Both inlets 13 and 12 to flow passages B and C, respectively are submerged in the water.

Referring again to FIGS. 2 to 6, when programmable cam 18 is set such that flow passage B will be opened for relatively short periods only, the propeller 34 will be activated during these short periods only. Since valves 22 and 23 work in tandem, valve 23 will be open during the periods in which valve 22 is closed.

During these periods, substantially all the suction applied to the outlet 15 will be transmitted to the cleaner 37 to cause flow through the latter for it to move about in the pool under the influence of its own driving mechanism and to clean the floor and/or walls thereof.

However, when valve 22 is caused to open, valve 23 is caused to close. During these periods stream B1 is caused to enter through inlet 13 to impinge on the vanes of impeller 33 to cause rotation thereof.

The suction through the cleaner 37 during these periods will be interrupted by valve 23 so that cleaner 37 will be paralized. As shown in FIG. 2 propeller 34 will accordingly now be able to propel body 11 to displace cleaner 37 by hose 38 away from an obstacle which it in the mean time may have encountered.

It will be appreciated that many variations of the fluid flow regulating means according to the invention may be made by those skilled in the art without departing from the spirit and scope of this invention.

For example, although the displacement apparatus described hereabove with reference to the accompanying diagrams is a unit separate from the cleaner, it will be clear to those skilled in the art that the fluid flow regulator in the form of a displacement apparatus in other embodiments may form part of the cleaner head or body to constitute a single unit.

We claim:

1. Fluid flow regulating means comprising:

a first flow passage extending between an inlet thereto and an outlet therefrom;

a second flow passage extending between an inlet thereto and an outlet therefrom;

the outlets being adapted in use to be connected to a single suction source so that suction may be applied through both flow passages for causing fluid flow therethrough;

first and second valve assemblies operable to open and close the first and second flow passages, respectively;

at least one of the valve assemblies comprising a body defining a flow passage therethrough and a fluid pressure operable closure member for opening and closing said flow passage;

actuating means adapted to utilize suction pressure and relatively higher ambient pressure to vary pressure acting on the pressure operable closure member to operate the member; and fluid driven means adapted to drive the actuating means to operate the valve assemblies to open and close their respective passages in tandem so that when one passage is open, the other is closed.

2. Fluid flow regulating means as claimed in claim 1 comprising a body wherein the first and second flow passages are defined and wherein the flow passages converge into each other downstream of the valve assemblies.

3. Fluid flow regulating means as claimed in claim 1 wherein the actuating means is adapted to operate the valves to open and close their respective flow passages for predetermined periods in response to predetermined volumes of fluid having passed the fluid driven means.

4. Fluid flow regulating means as claimed in claim 1 wherein the actuating means is adapated periodically to vary pressure acting on the pressure operable closure member to operate such member.

5. Fluid flow regulating means comprising:

a first flow passage extending between an inlet thereto and an outlet therefrom;

a second flow passage extending between an inlet thereto and an outlet therefrom;

the outlets being adapted in use to be connected to a single suction source so that suction may be applied through both flow passages for causing fluid flow therethrough;

first and second valve assemblies operable to open and close the first and second flow passages, respectively at least one of the valve assemblies comprising a body defining a flow passage therethrough and a pressure operable closure member for opening and closing the flow passage;

actuating means adapted to operate the two valve assemblies;

fluid driven means adapted to drive the actuating means to operate the valve assemblies to open and close their respective passages in tandem so that when one passage is open, the other is closed;

the actuating means comprising a variable volume chamber for causing the valve closure member to move between its open and closed positions, a variable pressure chamber communicating with the variable volume chamber and also with section pressure downstream of the closure member, the variable pressure chamber further having an equalization port communicating with ambient pressure; and a closure member for the equalization port operable by the fluid driven means to move between a position wherein it is in sealing engagement with the port and a position away from the port.

6. Fluid flow regulating means as claimed in claim 5 wherein the actuating means further comprises a gear train inter-connecting the fluid driven means and the closure member for the equalization port of the variable pressure chamber.

7. Fluid flow regulating means as claimed in claim 6 wherein a cam is provided for operating the closure member, the cam being connected to the output of the gear train the input of which is connected to the fluid driven means.

8. Fluid flow regulating means as claimed in claim 7 wherein the cam is programmable so that the intervals between opening and closing the equalization port may be adjusted.

9. Fluid flow regulating means as claimed in claim 7 or wherein the closure member for the equalization port is lever operable and biassed towards a position wherein it is in sealing engagement with the port and wherein the cam is engageable with the lever to move the closure member between the position wherein it is in sealing engagement with the port and the position away from the said port.

10. Fluid flow regulating means as claimed in claim 5 wherein the valve closure member of at least one of the valve assemblies comprises a transversely contractable and expansible tubular member the bore of which defines at least part of the flow passage through the valve body and wherein the variable volume chamber is located in the valve body immediately externally of the tubular member.

11. Fluid flow regulating means as claimed in claim 5 wherein the variable volume chamber associated with at least one of the valve closure members is defined within a longitudinally contractable and expansible bellows member, the bellows member being connected at its one end to the valve closure member for periodically moving the closure member between its open and closed positions.

12. Fluid flow regulating means as claimed in claim 11 wherein the valve closure member is connected to the end of the bellows member by a tubular stem communicating at its one end with the chamber within the bellows member and at its other end with suction pressure through a bore defined through the closure member.

13. Fluid flow regulating means as claimed in claim 5 wherein the first inlet is connectable to a device submerged in a liquid, the second inlet is submersible in the liquid and the outlet is connectable to a suction source so that suction may be transmitted through the body to the device and to the second inlet; and wherein drive means operable by a stream of liquid through the second flow passage is provided to exert a force on the body and thereby also on the device to displace the same when the second valve assembly is caused to open to admit liquid through the second flow passage.

14. Fluid flow regulating means as claimed in claim 13 wherein the drive means comprises a propeller connected to be driven by an impeller rotatably mounted in the second flow passage and operative to drive the propeller when liquid is admitted through the second inlet.

15. Fluid flow regulating means as claimed in claim 5 wherein the first valve assembly comprises a body defining a flow passage therethrough and having a transversely contractable and expansible tubular member mounted in the body to define on the inside thereof at least part of the said flow passage and on the outside thereof a first variable volume chamber, the first variable volume chamber communicating with the variable pressure chamber; and wherein the second valve assembly comprises a body having a valve seat therein and a closure member operable to move between a position wherein it is in sealing engagement with the seat and a position away from the seat, the closure member being connected to one end of a longitudinally contractable and expansible bellows member defining a second variable volume chamber therein by a tubular stem communicating at its one end with the second variable volume chamber and at the other end with suction pressure through a bore defined in the closure member, the second variable volume chamber also communicating with the variable pressure chamber.

16. Fluid flow regulating means as claimed in claim 15 wherein the body also defines a third flow passage therethrough, the third flow passage extending between an inlet thereto and the outlet from the body and having a chamber intermediate the inlet and the outlet wherein the fluid driven means is mounted.

17. Fluid flow regulating means as claimed in claim 16 wherein the fluid driven means comprises a turbine.

18. Fluid flow regulating means as claimed in claim 5 comprising a body wherein the first and second flow passages are defined and wherein the flow passages converge into each other downstream of the valve assemblies.

* * * * *